United States Patent [19]

Whitman

[11] 4,426,598

[45] Jan. 17, 1984

[54] INCANDESCENT LAMP LEADS OF DISPERSION STRENGTHENED COPPER WIRES

[75] Inventor: Charles I. Whitman, Bay Village, Ohio

[73] Assignee: SCM Corporation, New York, N.Y.

[21] Appl. No.: 344,890

[22] Filed: Feb. 2, 1982

[51] Int. Cl.[3] ..... H01J 5/50

[52] U.S. Cl. ..... 313/331; 419/19; 420/469; 313/333

[58] Field of Search ..... 313/331, 332, 333, 468, 313/464, 470; 419/19, 20, 21, 22, 10, 12; 420/469, 489

[56] References Cited

U.S. PATENT DOCUMENTS

| | | | |
|---|---|---|---|
| 2,183,592 | 12/1939 | Silliman | 420/469 |
| 2,479,311 | 8/1949 | Christensen et al. | 420/469 |
| 3,179,515 | 4/1965 | Grant et al. | 75/206 |
| 3,352,667 | 11/1967 | Das et al. | 75/155 |
| 3,726,673 | 4/1973 | Greenwald, Jr. | 420/489 |
| 3,779,714 | 12/1973 | Nadkarni et al. | 419/19 |
| 4,118,256 | 10/1978 | Schmitt-Thomas et al. | 420/469 |
| 4,131,819 | 12/1978 | Graves | 313/331 |
| 4,138,623 | 2/1979 | McMillan | 313/331 |
| 4,208,603 | 6/1980 | Graves et al. | 313/1 |

*Primary Examiner*—Saxfield Chatmon

*Attorney, Agent, or Firm*—Robert A. Sturges; Merton H. Douthitt

[57] ABSTRACT

Substantially completely deoxidized dispersion strengthened copper leads in incandescent electric lamps.

20 Claims, 5 Drawing Figures

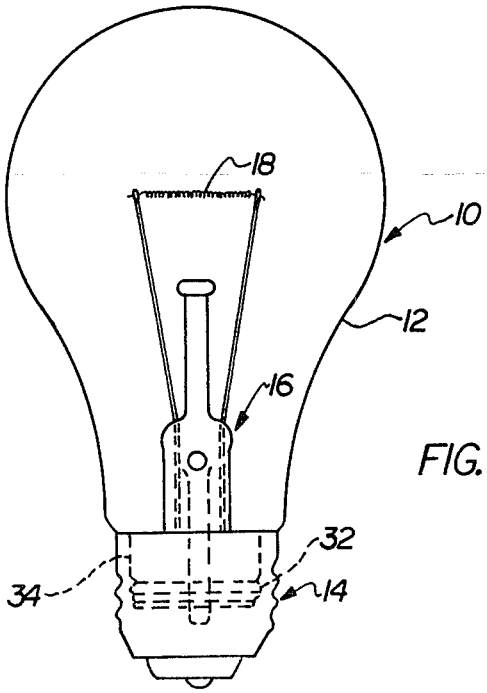
FIG. 1
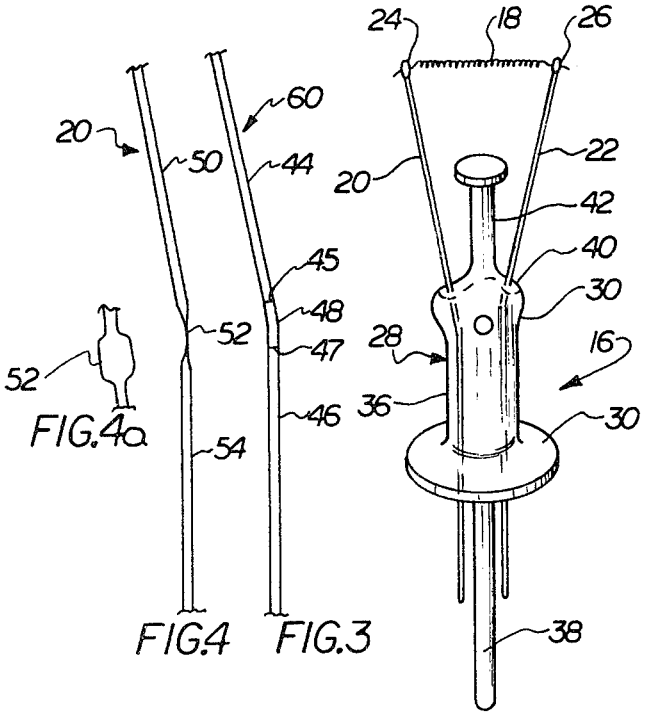
FIG. 4a
FIG. 4 FIG. 3
FIG. 2

INCANDESCENT LAMP LEADS OF DISPERSION STRENGTHENED COPPER WIRES

This invention relates to incandescent electric lamps, and particularly to improved lead wire for use in electric lamps.

BACKGROUND OF THE INVENTION AND PRIOR ART

The use of copper or various copper alloys as lead in wires in incandescent lamps has been in commercial practice for many years. More recently, dispersion strengthened copper has been used for such lead wires. (See McMillan U.S. Pat. No. 4,138,623). This dispersion strengthened copper wire was normally a "Glidcop" AL-20 wire or equivalent containing 0.20% aluminum oxide calculated as the metal equivalent and which had a thin copper (unstrengthened) sheath surrounding an inner core of the internally oxidized dispersion strengthened copper. This material, particularly when nickel plated to reduce release of contaminants from the underlying copper sheath, enabled lamp manufacturers to eliminate tie wires formerly used to support the plain copper or copper alloy leads and thus reduce cost.

Graves et al in U.S. Pat. No. 4,208,603 found that to improve the resistance to embrittlement of the tungsten filament due to nickel plated on copper sheathed dispersion strengthened copper, removal of the copper sheath, or production of the wire without the copper sheath, enabled plating of nickel directly onto the bare dispersion strengthened copper wire and gave a superior bonding of the nickel deposit onto the copper alloy surface. This structure was found to be less prone to nickel migration during lamp operation. Nickel migration was believed responsible for early filament failure due to embrittlement. As shown in U.S. Pat. No. 4,208,603, removal or omission of the copper sheath followed by nickel plating resulted in an improvement in filament life.

A problem still remained, however, with attack on the tungsten filament as a result of residual hydrogen on the tungsten and residual free oxygen in the lead wire or within the environment of the bulb albeit in very low concentrations. These elements combine to form water. Water vapor present in the system reacts with tungsten under incandescent temperature conditions to form tungsten oxide and hydrogen ions. The oxide vaporizes and condenses on the inner surface of the envelope. Ambient hydrogen ions under the condition of the lower temperature of the envelope reduces the tungsten to the metal and regenerates water vapor thereby completing what is known in the art as the "water cycle". To control plating out of tungsten onto the glass envelope, it has become the practice to include a "getter" at the outer end of the lead wire in the lamp reactive with the oxygen to reduce the deleterious effect thereof, and interrupt the "water cycle". Zirconium metal is a "getter" material which can be used for this purpose. Obviously, however, the inclusion of a "getter" in a lamp increases cost not only in respect of the cost of the material, but also in the added operation of applying it to the lead wire.

In the following discussion dispersion strengthened copper may be referred to as "DSC". Reference to an aluminum metal content of a given percentage will be understood as an equivalent amount of aluminum metal albeit present as the refractory oxide, aluminum oxide.

Thus, the art has progressed to the point where it was using dispersion strengthened copper (DSC) wire leads, without tie wires. Because undeoxidized DSC containing refractory metal oxide to any extent contains residual free oxygen and is thus a source contributing to the "water cycle", control of contaminents from the wire was achieved by nickel plating with improved bond, or by use of any auxiliary getter, or a combination of both.

Also, as known to those skilled in the art (See U.S. Pat. No. 4,138,623; Col. 2., Lines 2–14) lead wires are composed of three electrically conductive segments; an outer conductor and an inner conductor connected together through a short intervening segment of dumet wire. This segment is adapted and dimensioned to traverse the steam press portion of the glass stem to provide a seal between the inside and outside of the glass envelope. Dumet, which is a 40–43% nickel balance iron alloy, because of its favorable thermal expansion characteristics reduces the stresses due to differences in thermal radial expansion of the wire and the glass in the formation of the stem press and in actual use. The heat of softening the glass to make the stem press seal (about 1200° F.) is sufficient to soften copper metal or copper alloys in a normal lead wire. A DSC wire is better able to withstand such temperature. It has now been found that use of nickel plating and/or use of an auxiliary use of nickel plating and/or use of an auxiliary "getter" and the attendant costs of each can be avoided while still maintaining the desired objective of eliminating the need for tie wires. This is achieved by use of a deoxidized internally oxidized dispersion strengthened copper wire, and particularly a deoxidized internally oxidized dispersion strengthened copper wire having a lower aluminum oxide (or equivalent refractory oxide) content than heretofore used. A principal source of free oxygen in the lamp environment is thereby substantially removed and the "water cycle", thus effectively controlled. Use of the lower oxide deoxidized DSC also presents advantages of greater ductility which facilitates fabrication and provides better electrical conductivity. A "getter" for any extraneous free oxygen can be incorporated in the body of the wire rather than topically applied after fabrication.

Still further, when the refractory oxide content in the DSC is as low as 0.15% aluminum equivalent, it has been found that use of a dumet segment can be avoided, if desired.

BRIEF STATEMENT OF THE INVENTION

Briefly stated, therefore, the present invention is in an electric incandescent lamp having a translucent envelope for enclosing a resistive incandescent filament. The filament is electrically connected to and supported by a pair of lead wires. The lead wires comprise at least in part, substantially completely deoxidized internally oxidized dispersion strengthened copper wire. Such wire may contain aluminum oxide to the extent of 0.07% to 0.35% aluminum metal as the oxide. In preferred embodiments of the invention, I use deoxidized internally oxidized dispersion strengthened copper containing dispersed therein metal oxide refractory to the extent of no more than about 0.15% calculated as the metal equivalent. The wire may be unclad, or it may be clad with copper, nickel or other cladding metal or metal alloy, if desired. Desirably, the deoxidized internally oxidized dispersion strengthened copper also containing as a result of boron deoxidation, unreacted boron in an amount of from 0.001% to about 0.06%. It is preferred that the wire be formed by powder metallurgy techniques optionally with a thin copper sheath.

BRIEF DESCRIPTION OF THE DRAWINGS

A preferred embodiment of the invention is illustrated in the annexed drawings wherein:

FIG. 1 is a cross-section of an incandescent lamp of the present invention.

FIG. 2 is a perspective view showing a filament mount construction for the lamp shown in FIG. 1.

FIG. 3 is a fragmentary view on an enlarged scale showing a lead wire having inner and outer lead portions with an intermediate dumet portion.

FIGS. 4 and 4*a* are fragmentary views also on an enlarged scale showing another lead wire with a flattened intermediate portion.

DETAILED DESCRIPTION OF THE PRESENT INVENTION

Referring now more particularly to FIG. 1 there is shown in cross section an incandescent lamp 10 having a translucent envelope, for example, a frosted glass envelope 12, which is secured to a base member 14 to provide a housing assembly for a filament mount construction 16 upon which is supported the resistive incandescent filament 18 that serves as the illumination source in said lamp. An inert gas or a vacuum is further provided within the hermetically sealed envelope to protect against filament oxidation during lamp operation. The filament material is generally tungsten or some other suitable refractory metal including alloys thereof. The word "translucent" is used herein signifies the ability to transmit visible light, and contemplates coloration of the envelope material itself as well as coating the lamp envelope with materials which diffuse or reflect light.

The filament mount construction 16 also preferably of glass and as better shown in FIG. 2, comprises a filament coil 18 disposed transverse to the axis of the lamp 10, and supported by a pair of lead wires 20 and 22 that are electrically connected at each end 24 and 26, respectively, to the filament coil 18. A central glass member 28 in the filament mount construction 16 is provided having a flared portion 30 which is sealed directly to a restricted neck portion 32 of the lamp glass envelope 12 at the base of the bulb portion 34 (FIG. 1). The translucent body 28 is in the form of a hollow tube 36 which includes an inner glass exhaust tube 38 and with the glass body member 28 further including a stem press 40 at the opposite end of said member 28 from the flared portion 30 to provide a hermetic seal for the filament 18 and lead wires 20 and 22 in the lamp. It is through the stem press 40 that a dumet segment is commonly used for providing a better seal and more nearly matched coefficients of expansion between the glass and the metal. Protruding from the same end of the glass body member 28 as the lead wires 20 and 22 is an extension 42 which terminates in a button 44 used for securing tie wires (not shown) in the construction. The extension 42 has now become superfluous as filament support means and could be eliminated for simplification of the mount construction now being used. However, machinery is already in place which provides the extension 42.

The improved glass mount construction shown in FIG. 2 utilizes lead wires 20 and 22 made in accordance with the present invention. These lead wires need not be segmented to insert a dumet segment. In a specific embodiment, the lead wires 20 and 22 are constructed entirely from deoxidized internally oxidized dispersion strengthened copper alloy wire. In preferred embodiments, the deoxidized internally oxidized dispersion strengthened copper is characterized in that it contains a metal oxide refractory to the extent of no more than about 0.15% by weight aluminum and has been substantially completely deoxidized to reduce the free oxygen content to below about 0.002%. Any suitable deoxidizing means may be employed. I prefer, however, to utilize boron. One method of deoxidizing copper which is suitable for use in accordance with the present invention is described in U.S. Pat. No. 3,352,667 to Das et al. Alternatively to the Das et al process, boron in powder form can be blended with internally oxidized dispersion strengthened copper powder in an amount of about 0.02% to about 0.1% prior to compacting during extrusion and drawing of the wire to effect an internal sequestering of free oxygen. A slight excess of the boron over that required to completely deoxidize the wire is preferred to act as an integral "getter" for other extraneously introduced oxygen that may be present within the glass envelope. In general, an excess sufficient to yield from 0.001% to about 0.01% free boron in the final product is sufficient.

FIGS. 3 and 4 show other forms of lead wires fabricated of deoxidized dispersion strengthened copper. In FIG. 3 there is shown a lead wire 20 having three segments connected in tandem. In a preferred embodiment of FIG. 3, inner lead portion 44 and outer lead portion 46 are each formed of deoxidized 0.15% aluminum internally oxidized dispersion strengthened copper. Portions 44 and 46 are joined by a dumet segment 48 welded to confronting ends 45 and 47. The outer lead portions, e.g., portion 46 are adapted in the base 14 to be connected to opposite sides, respectively, of a source of electric current, not shown.

FIG. 4 shows another lead wire 20 having 3 portions connected in tandem. Inner lead portion 50 and outer lead portion 54 are each formed of deoxidized 0.07% to 0.35% aluminum internally oxidized dispersion strengthened copper. Portions 50 and 54 are joined by a flattened segment 52 also of the same dispersion strengthened copper. Where the lead is entirely of DSC, it is desirable to provide a thicker sheath of copper to better accommodate stress in the stem press portion. With thicker sheaths one would use a correspondingly higher aluminum content in the DSC to retain wire strength. copper. Segments 48 and 52 are desirably longitudinally dimensioned to match the depth of the stem press portion 40 of the glass stem 16. (FIG. 2). The stem press traversing portion 52 may have a thickness of 0.1 to 0.2 millimeters compared to the normal wire diameter of 0.35 millimeters (0.014" or 30 gauge). The wires of FIGS. 3 and 4 have no nickel cladding or plating, i.e., are nickel free.

The internally oxidized dispersion strengthened copper may be produced in the form of a powder by the process described in the Nadkarni Pat. No. 3,779,714. Although other methods of dispersion strengthened of copper than those described in the aforesaid U.S. Pat. No. 3,779,714 may be used to produce dispersion strengthened copper we prefer the process described and claimed in said patent. As indicated above, the amount of aluminum as aluminum oxide in the final product is desirably carefully controlled to be 0.15% or less down to about 0.07%. When the internally oxidized dispersion strengthened copper is deoxidized to remove free oxygen by a process such as described by Das (supra), it is substantially free of uncombined oxygen.

The ordinary method for producing wire from such dispersion strengthened copper powder is to place the powder in a "can" which is then suitably sealed and reduced in size by any suitable means such as extruding and drawing, until the final diameter is approximately 0.014 inch. Wire extruded to this diameter from a ¾ inch diameter can yields a substantially fully densified dispersion strengthened copper material contained within a very thin wall sheath. The sheath may be of copper, or of nickel. Alternatively, the copper sheath which is usually produced in making dispersion strengthened copper wire may be removed as described in the aforesaid U.S. Pat. No. 4,208,603, and a coating of nickel electroplated directly on to the dispersion strengthened copper wire. Thus, the deoxidized dispersion strengthened copper wire may be provided with or without a metal sheath. Reference may be had to U.S. Pat. No. 3,179,515 to Grant for one method of forming dispersion strengthened copper wire.

In use, the deoxidized internally oxidized dispersion strengthened copper wire of the present invention is utilized in exactly the same manner as taught in the aforesaid U.S. Pat. No. 4,208,603. No dumet segment is required although it may if desired by provided and the lead wires need not be supported by tie wires. Alternatively, because the 0.15% aluminum copper wire retains ductility, it may be flattened in the region of the stem press 40 to improve the sealing and thermal characteristics. It has been found that with such deoxidized internally oxidized dispersion strengthened copper wire, including a slight excess of boron over that required to react with free oxygen, the application of a "getter" such as zirconium metal at or near the point of attachment of the tungsten filament 18 to the free ends 24 and 26 of the lead wires 20 and 22, respectively, can be avoided. Filament life for the improved structure is substantially the same as that achieved with the system which contains a "getter". The cost of the "getter" and the operation for applying the "getter" to the insert assembly such as shown in FIG. 2 is thereby obviated. The use of a nickel coating can also be avoided, if desired. Still further, the use of a dumet segment can also be avoided particularly with the low oxide DSC. The low oxide DSC because of its ductility permits flattening of the stem seal traversing portion whereby a continuous wire lead may be produced from a single piece of DSC wire.

What is claimed is:

1. An incandescent electric lamp having a translucent envelope which encloses a resistive incandescent filament electrically connected to and supported by a pair of lead wires comprising at least in part substantially completely deoxidized internally oxidized dispersion strengthened copper wire in which is dispersed a metal oxide refractory to the extent of from 0.07% to 0.35% calculated as its metal equivalent, said lead wires containing from 0.001% to 0.06% free boron and less than 0.002% free oxygen.

2. The lamp as defined in claim 1 wherein the dispersion strengthened copper wire is unsheathed.

3. The lamp as defined in claim 1 wherein the dispersion strengthened copper wire is encased in a thin metal sheath.

4. The lamp as defined in claim 3 wherein the thin metal sheath is copper metal.

5. The lamp as defined in claim 3 wherein the thin metal sheath is nickel.

6. The lamp as defined in claim 1 wherein the dispersion strengthened copper wire is deoxidized with boron.

7. The lamp of claim 1 where said lead wires are formed by powder metallurgy.

8. The lamp as defined in claim 1 wherein the lead wires each comprise an inner portion and an outer portion.

9. The lamp as defined in claim 8 wherein the inner and outer portions are bridged by a dumet portion.

10. The lamp as defined in claim 8 wherein the inner and outer portions are a continuous deoxidized internally oxidized dispersion strengthened copper wire containing no more than about 0.15% aluminum oxide calculated as aluminum.

11. The lamp as defined in claim 10 wherein the wire is flattened intermediate its ends.

12. An incandescent electric lamp having a translucent envelope and a glass stem portion sealed to said envelope, said glass stem portion having extending therethrough a pair of lead wires each having an inner portion adapted to support one end of a resistive filament, and an outer portion adapted to be connected at its distal extremity to one side of an electric power source, said glass stem portion including a stem press portion adapted to sealingly engage the lead wires to hermetically seal the lamp, said lead wires comprising at least in part substantially completely deoxidized internally oxidized dispersion strengthened copper wire in which is dispersed a metal oxide refractory to the extent of no more than about 0.15% calculated as its metal equivalent, said lead wires containing from 0.001 to 0.06% free boron and less than 0.002% free oxygen.

13. A lamp as defined in claim 12 herein the metal oxide refractory is aluminum oxide.

14. A lamp as defined in claim 12 wherein the lead wires each comprise an inner portion, an outer portion and an intermediate portion adapted to pass through the stem press portion, said portions being electrically connected in tandem.

15. A lamp as defined in claim 14 wherein the intermediate portion is formed of dumet.

16. A lamp as defined in claim 14 wherein the intermediate portion is flattened and continuous with said inner and outer portions.

17. An incandescent electric lamp having a translucent envelope which encloses a resistive incandescent filament electrically connected to and supported by a pair of lead wires, said lamp being characterized by the absence of any supplemental oxygen getter, and said lead wires comprising at least in part substantially completely deoxidized internally oxidized dispersion strengthened copper wire in which is dispersed a metal oxide refractory to the extent of no more than about 0.15% calculated as its metal equivalent, said lead wires containing from 0.001% to 0.06% free boron and less than 0.002% free oxygen.

18. An incandescent electric lamp having a translucent envelope which encloses a resistive incandescent filament electrically connected to and supported by a pair of lead wires, said lead wires comprising at least in part substantially completely deoxidized internally oxidized dispersion strengthened copper wire free of any nickel cladding thereon, said lead wires containing from 0.001% to 0.06% free boron and less than 0.002% free oxygen.

19. An incandescent electric lamp having a translucent envelope which encloses a resistive incandescent filament electrically connected to and supported by a pair of lead wires, said lead wires comprising at least in part substantially completely deoxidized internally oxidized dispersion strengthened copper wire free of any nickel cladding thereon and wherein the dispersion strengthened copper contains free boron in an amount of from 0.001% to about 0.06% by weight, said lead wires containing less than 0.002% free oxygen.

20. An incandescent electric lamp having a translucent envelope and a glass stem portion sealed to said envelope, said glass stem portion having extending therethrough a pair of lead wires each having an inner portion adapted to support one end of a resistive filament, and an outer portion adapted to be connected at its distal extremity to one side of an electric power source, said glass stem portion including a stem portion adapted to sealingly engage the lead wires to hermetically seal the lamp, said lead wires comprising at least in part sheathed internally oxidized dispersion strengthened copper wire in which is dispersed a metal oxide refractory to the extent of from 0.07% to 0.35% calculated at its metal equivalent, said lead wires containing from 0.001% to 0.06% free boron and less than 0.002% free oxygen.

* * * * *